US008800716B2

(12) United States Patent
Morelli et al.

(10) Patent No.: US 8,800,716 B2
(45) **Date of Patent: *Aug. 12, 2014**

(54) ADJUSTABLE WORK PLATFORM FOR PIPE AND CASING STABBING OPERATIONS

(75) Inventors: Vince Morelli, Red Deer County (CA); Darcy Ludwing, Red Deer (CA)

(73) Assignee: Superior Rig Solutions Inc., Alberta (CA)

( * ) Notice: Subject to any disclaimer, the term of this patent is extended or adjusted under 35 U.S.C. 154(b) by 37 days.

This patent is subject to a terminal disclaimer.

(21) Appl. No.: 13/615,490

(22) Filed: Sep. 13, 2012

(65) Prior Publication Data

US 2013/0008720 A1 Jan. 10, 2013

Related U.S. Application Data

(63) Continuation of application No. 12/353,993, filed on Jan. 15, 2009, now Pat. No. 8,297,405.

(51) Int. Cl.
*E04G 3/00* (2006.01)

(52) U.S. Cl.
USPC ..... 182/82; 182/141; 182/2.2; 175/219

(58) Field of Classification Search
USPC ..... 182/37, 82, 2.1, 2.9, 2.11, 2.6, 2.8, 2.2; 248/278.1; 175/85, 219; 414/22.51, 414/22.65, 22.69, 22.67
See application file for complete search history.

(56) References Cited

U.S. PATENT DOCUMENTS

| | | | |
|---|---|---|---|
| 1,977,484 | A | 10/1934 | Lagerquist et al. |
| 2,425,302 | A | 4/1947 | Calhoun |
| 2,582,528 | A | 1/1952 | Cranford |
| 3,670,849 | A | 6/1972 | Milner, Jr. |
| 4,077,525 | A | 3/1978 | Callegari et al. |
| 4,157,129 | A | 6/1979 | Christopher |
| 4,262,777 | A | 4/1981 | Christopher |
| 4,326,602 | A | 4/1982 | Bryant |
| 2008/0029670 | A1 | 2/2008 | Hung |
| 2010/0108441 | A1 | 5/2010 | Morelli et al. |
| 2010/0294594 | A1 | 11/2010 | Campbell et al. |

FOREIGN PATENT DOCUMENTS

| | | |
|---|---|---|
| GB | 2119749 | 11/1983 |
| JP | 3-200696 | 9/1991 |

*Primary Examiner* — Blair M. Johnson
(74) *Attorney, Agent, or Firm* — The Weintraub Group, P.L.C.

(57) ABSTRACT

A stabbing basket, for a rig and for supporting a worker while stabbing joints of tubular members together during running operations, comprises a frame member for mounting the stabbing basket to the rig, a platform to support the worker, a carriage to slidably mount the platform to the frame member, vertical power means for moving the carriage vertically with respect to the frame member, an articulating boom, interconnecting the platform with the carriage, said articulating boom comprising a first segment and a second segment, and at least one pivoting actuator positioned between the first segment and the second segment.

11 Claims, 12 Drawing Sheets

ADJUSTABLE WORK PLATFORM FOR PIPE AND CASING STABBING OPERATIONS

CROSS REFERENCE TO RELATED APPLICATION

This application is a continuation of co-pending U.S. application Ser. No. 12/353,993, which was filed on Jan. 15, 2009, the disclosure of which is hereby incorporated by reference.

FIELD OF THE INVENTION

The present invention relates generally to a handling board or platform and, more particularly, to a stabbing basket assembly mountable on a well derrick for supporting a worker while stabbing joints of pipe or casing during running operations.

BACKGROUND OF THE INVENTION

It is common practice in the oil and gas well drilling art to provide some form of support or platform for accommodating an operator or worker at a position above the floor of the derrick, particularly during a running of pipe or tubulars into the well, in order to assist in properly axially aligning the tubulars during the stabbing operation. Typically this is accomplished through the use of casing stabbing boards, which are hung or suspended on wirelines held within the derrick or drilling rig. Stabbing or casing baskets which travel up and down along a vertical track on the inside or outside of a derrick and which have a telescoping boom to move a basket away or towards vertical track are also known in the art.

However, the prior art stabbing boards and stabbing baskets suffer from a number of disadvantages, such as not provide for sufficient horizontal movement of the platform to allow an operator to be placed in sufficient proximity to the pipe or tubulars during stabbing operations, not being easily stowed away in compact format (so as to reduce interference with rig operations when such a platform is not needed) and not being able to easily, if at all, move around the pipe or tubulars during stabbing operations (so as to allow an operator to reach the other side of such pipe or tubular).

Accordingly, there still exists a need to for an improved stabbing basket that addresses these disadvantages.

SUMMARY OF THE INVENTION

The present invention provides improvements to stabbing boards and stabbing baskets.

In one embodiment, the present invention provides a stabbing basket for a rig and for supporting a worker while stabbing joints of tubular members together during running operations, comprising a frame member for mounting the stabbing basket to the rig, a platform to support the worker, a carriage to slidably mount the platform to the frame member, vertical power means for moving the carriage vertically with respect to the frame member, an articulating boom to interconnect the platform with the carriage and to facilitate horizontal and vertical movement of the platform relative to the carriage and frame member, said articulating boom comprising a first segment and a second segment and at least one pivoting actuator positioned between the first segment and the second segment.

BRIEF DESCRIPTION OF THE DRAWINGS

Embodiments of the invention will now be described, by way of example only, with reference to the accompanying drawings, wherein.

DETAILED DESCRIPTION OF THE PREFERRED EMBODIMENTS

Figure 1:
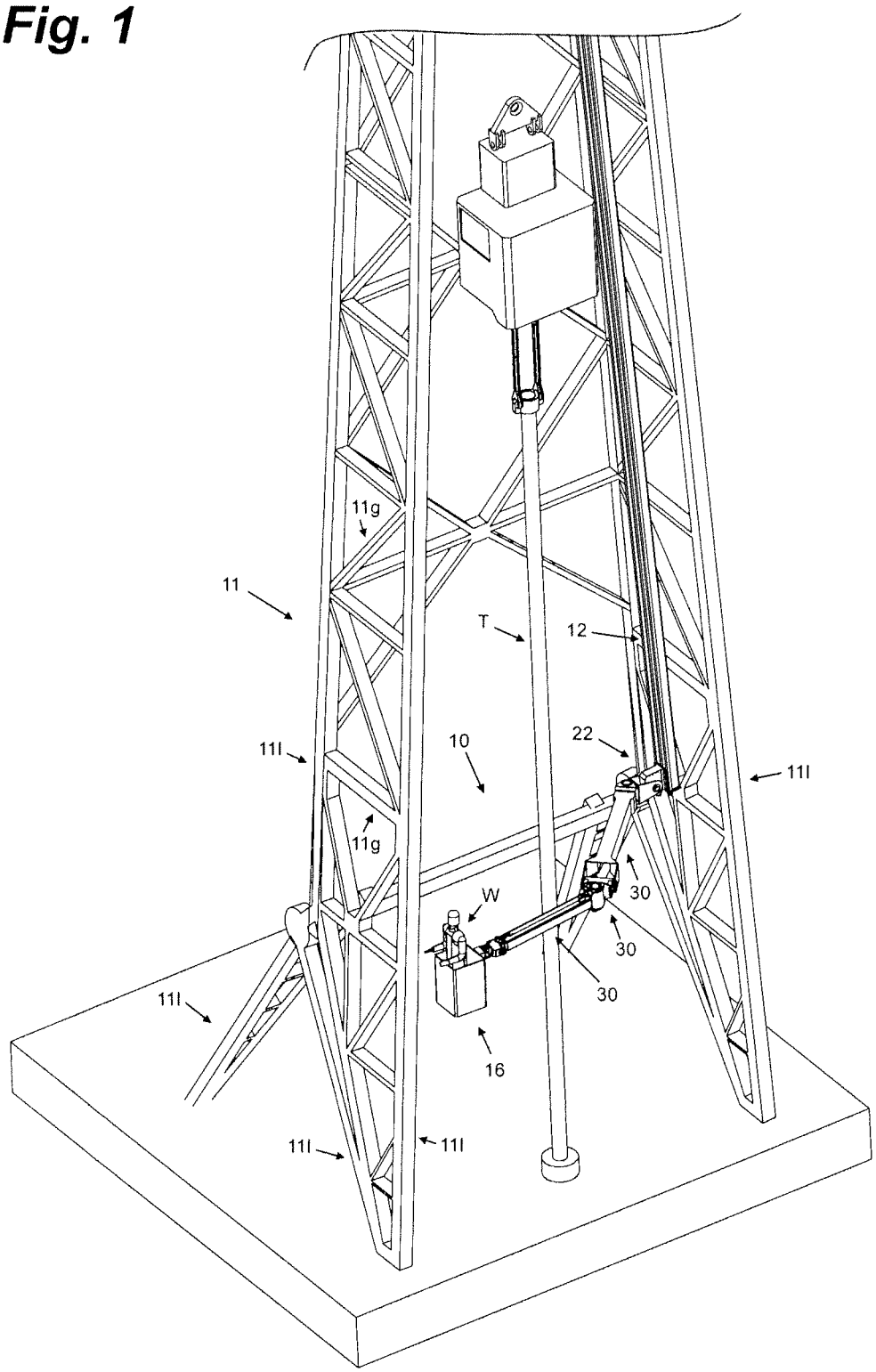
FIG. 1 is a top-side perspective view of a stabbing basket according to a preferred embodiment of the invention, showing the articulating boom extended substantially horizontally away from the frame member and around the tubulars.

The following description is of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic form in the interest of clarity and conciseness.

Figure 2:
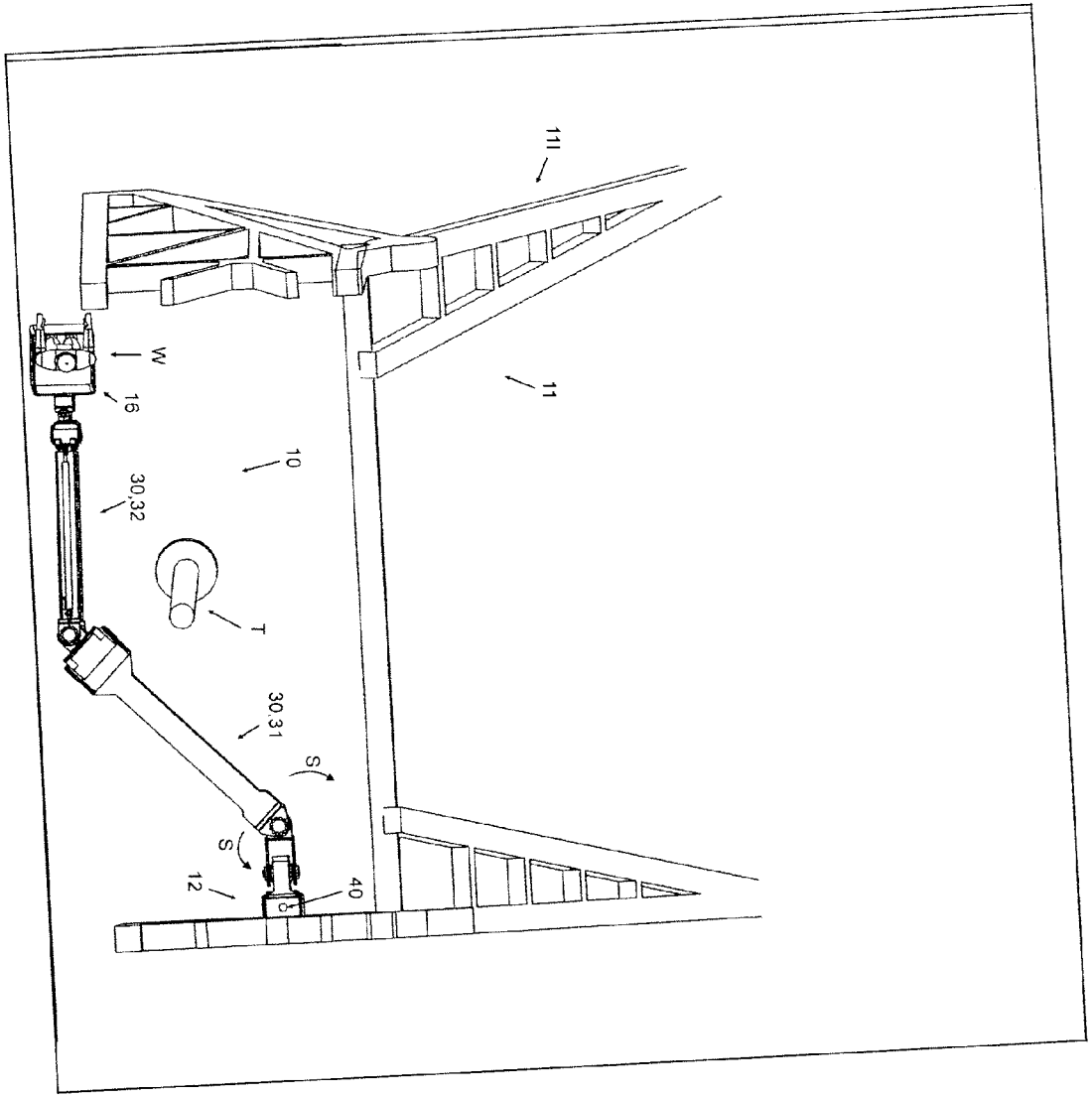
FIG. 2 is a top perspective view of the stabbing basket of the embodiment of FIG. 1, still showing the articulating boom extended around the tubulars.
Figure 3:
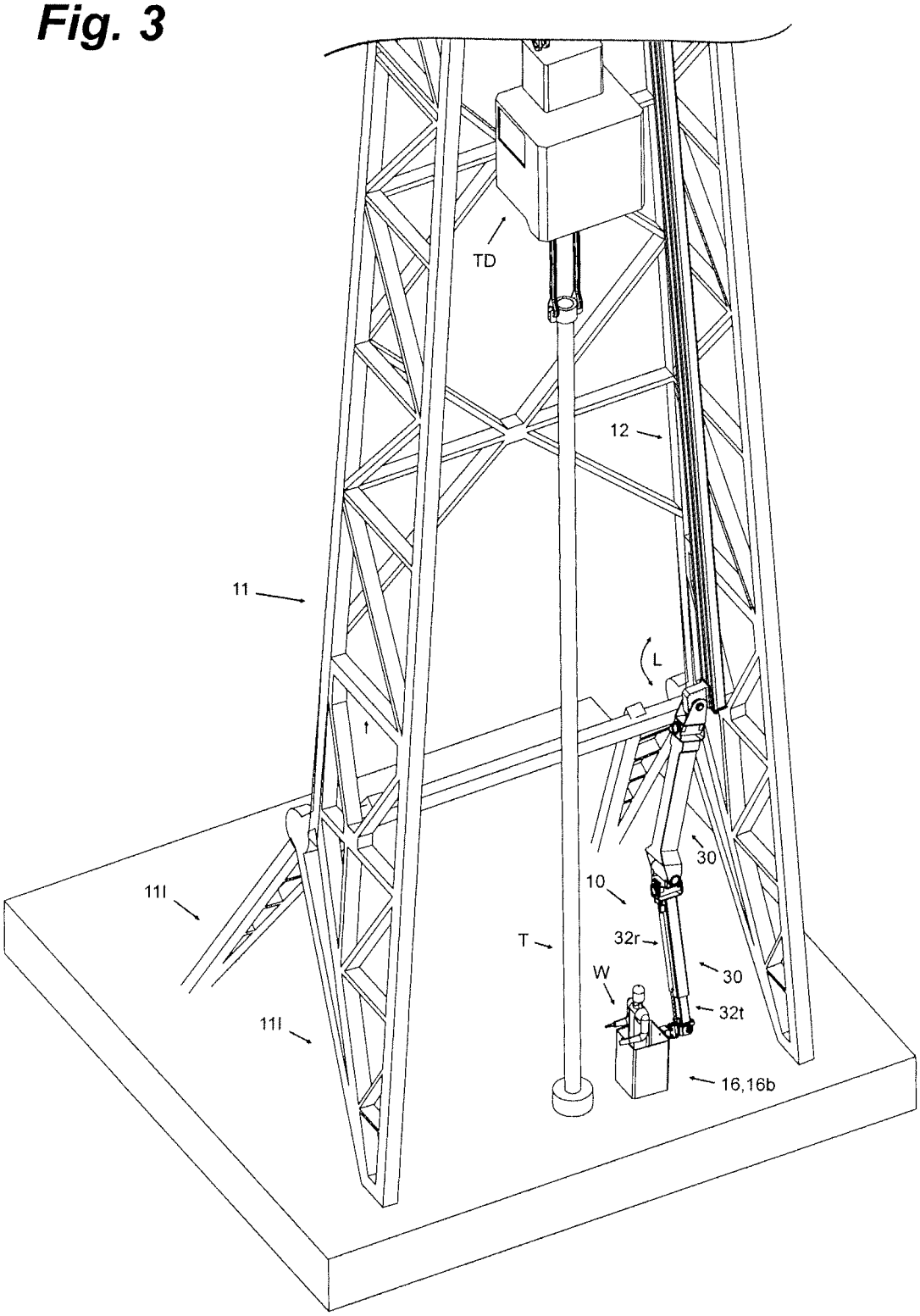
FIG. 3 is a side perspective view of the stabbing basket of the embodiment of FIG. 1, now showing the articulating boom extended substantially vertical and downward, positioning the platform at or near the rig floor allowing ease of entry or exit of a worker on or off the platform.
Figure 4:
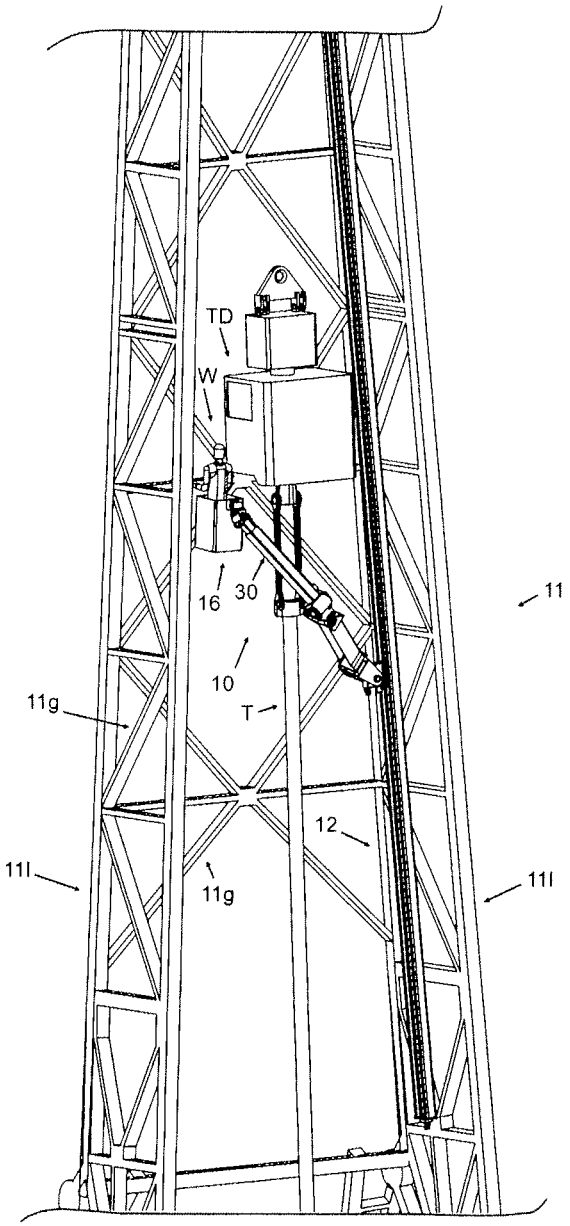
FIG. 4 is a side perspective view of the stabbing basket of the embodiment of FIG. 1, now showing the articulating boom extended at an angle relative to the frame member, positioning the platform and worker adjacent the rig's top drive.
Figure 5:
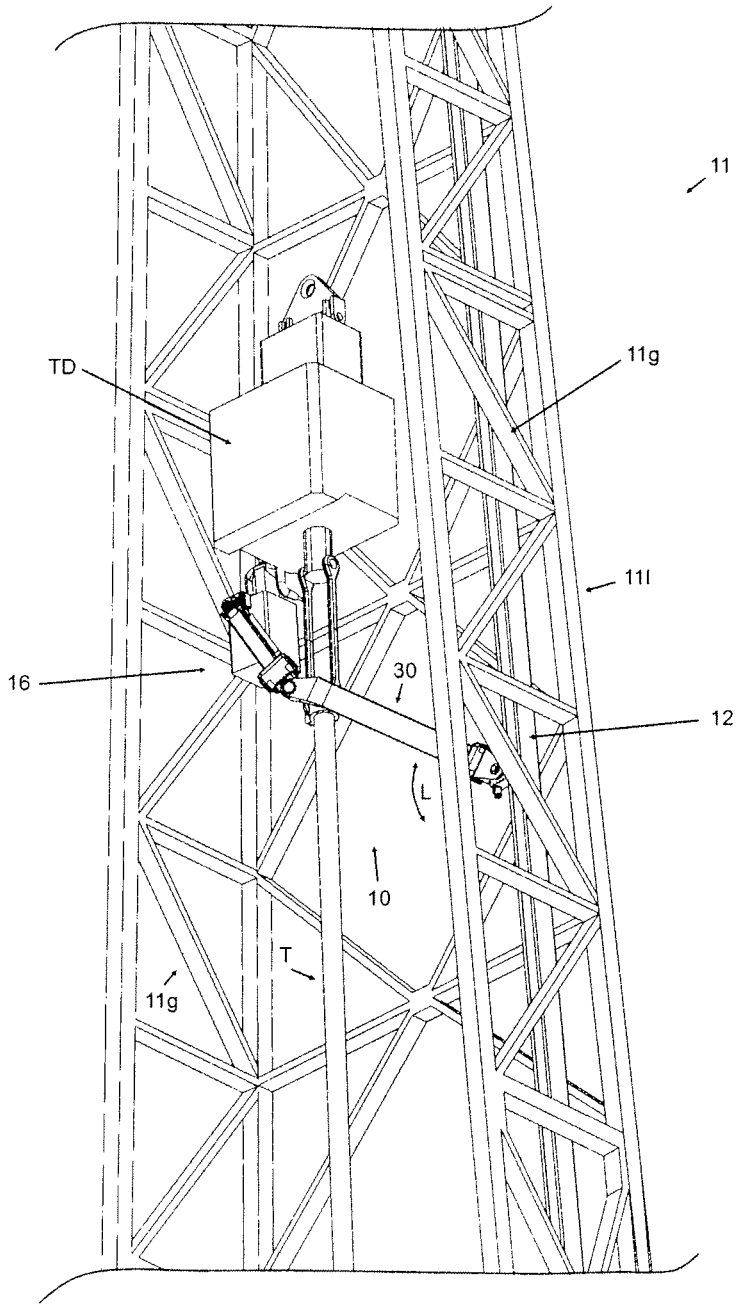
FIG. 5 is a bottom perspective view of the stabbing basket of the embodiment of FIG. 1, still showing the articulating boom extended at an angle relative to the frame member, positioning the platform and worker adjacent the rig's top drive.
Figure 6:
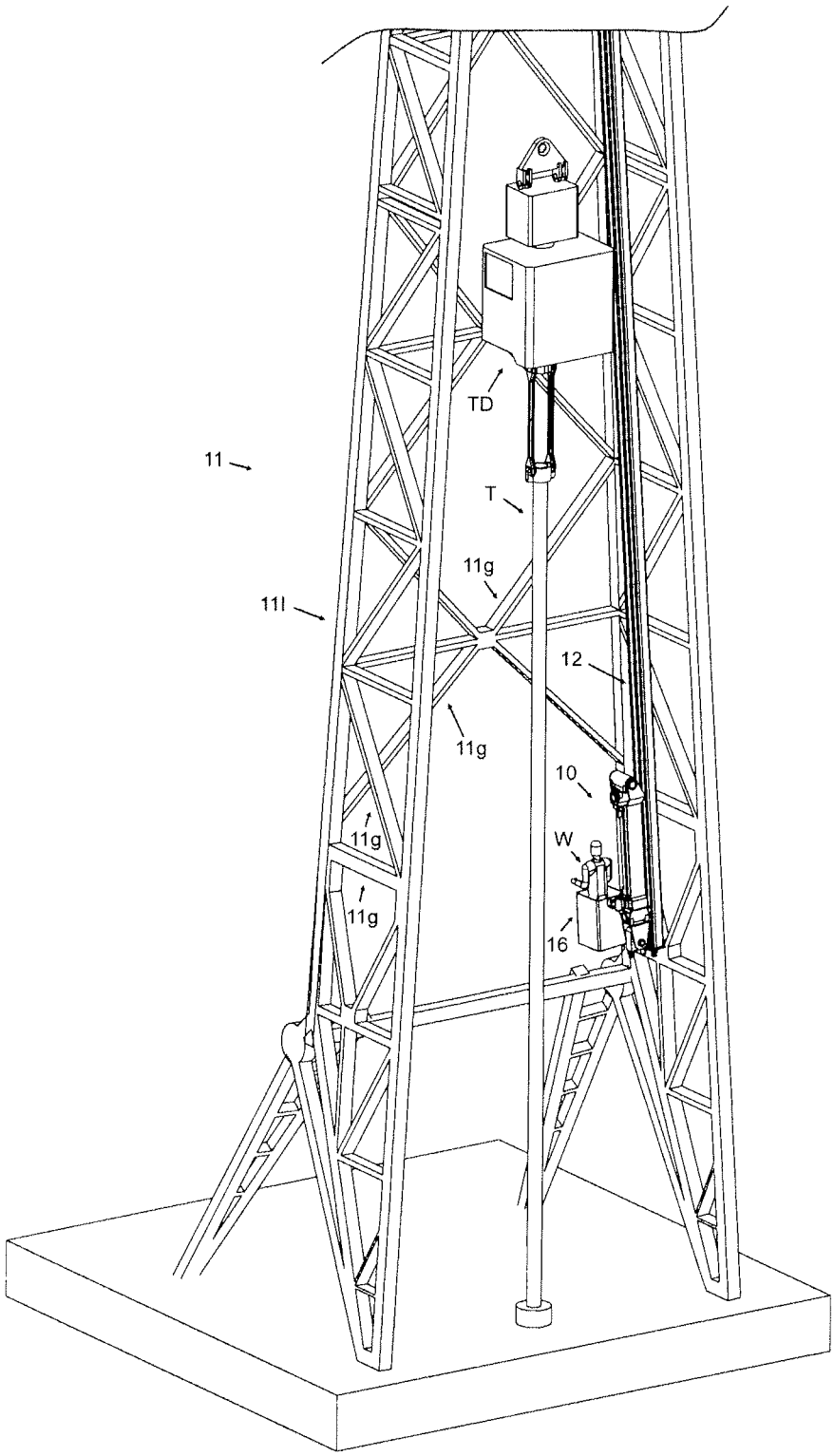
FIG. 6 is a side perspective view of the stabbing basket of the embodiment of FIG. 1, now showing the articulating boom articulated into a compact stowing position.
Figure 7:
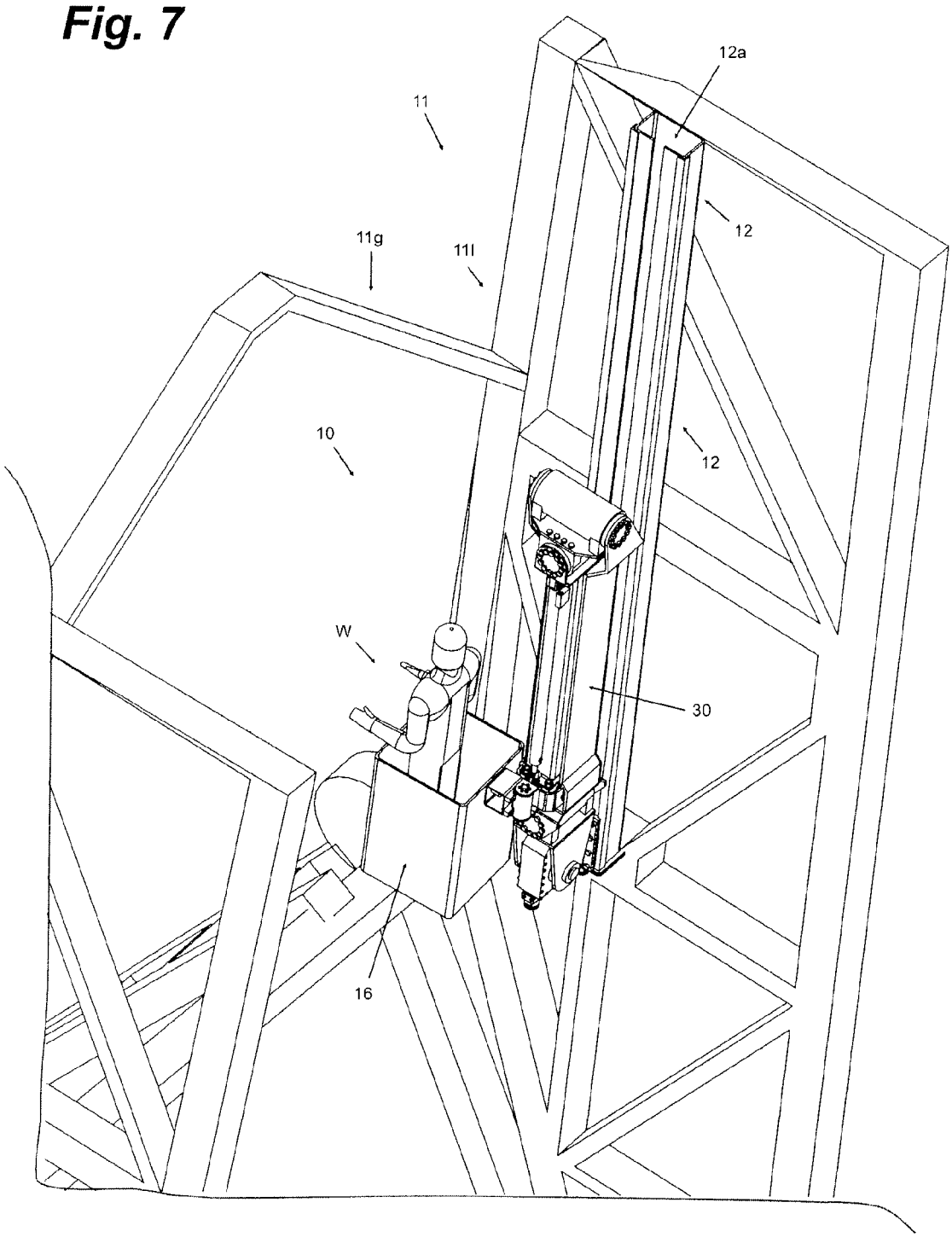
FIG. 7 is another side perspective view of the stabbing basket of the embodiment of FIG. 1, still showing the articulating boom articulated into a compact stowing position.
Figure 8:
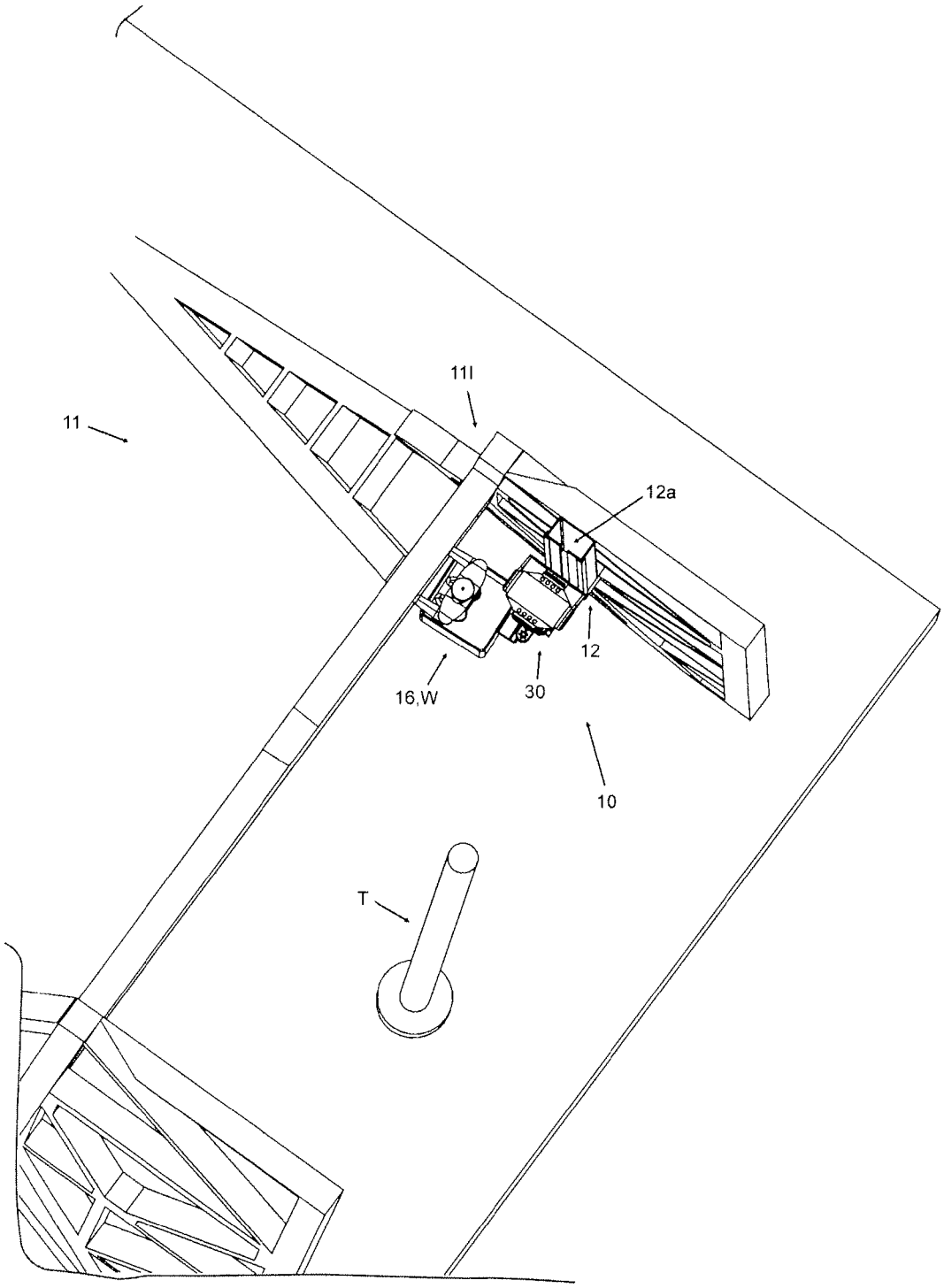
FIG. 8 is a top perspective view of the stabbing basket of the embodiment of FIG. 1, still showing the articulating boom articulated into a compact stowing position.
Figure 9:
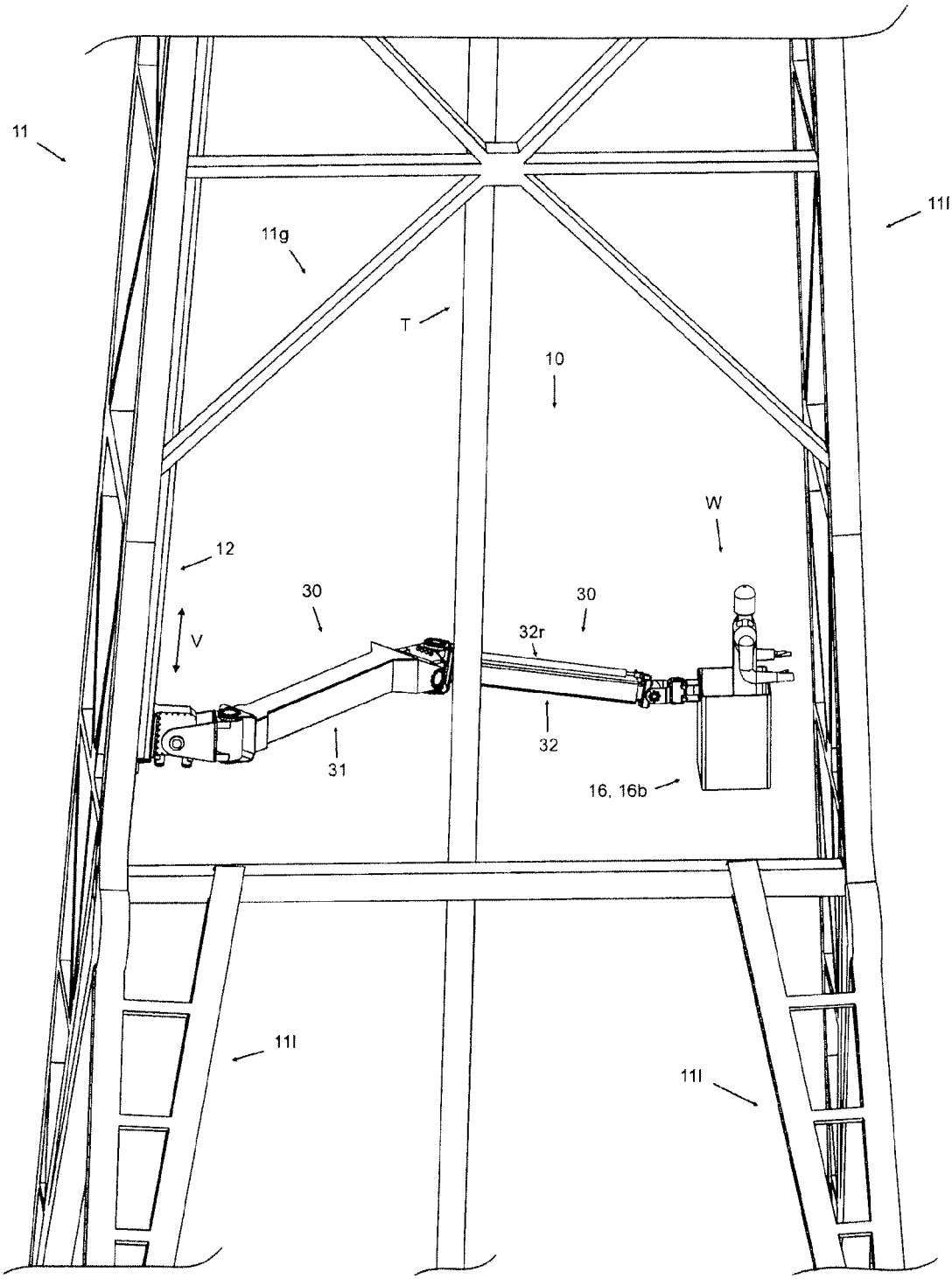
FIG. 9 is another side perspective view of the stabbing basket of the embodiment of FIG. 1, once again showing the articulating boom extended substantially horizontally away from the frame member and around the tubulars.
Figure 10:
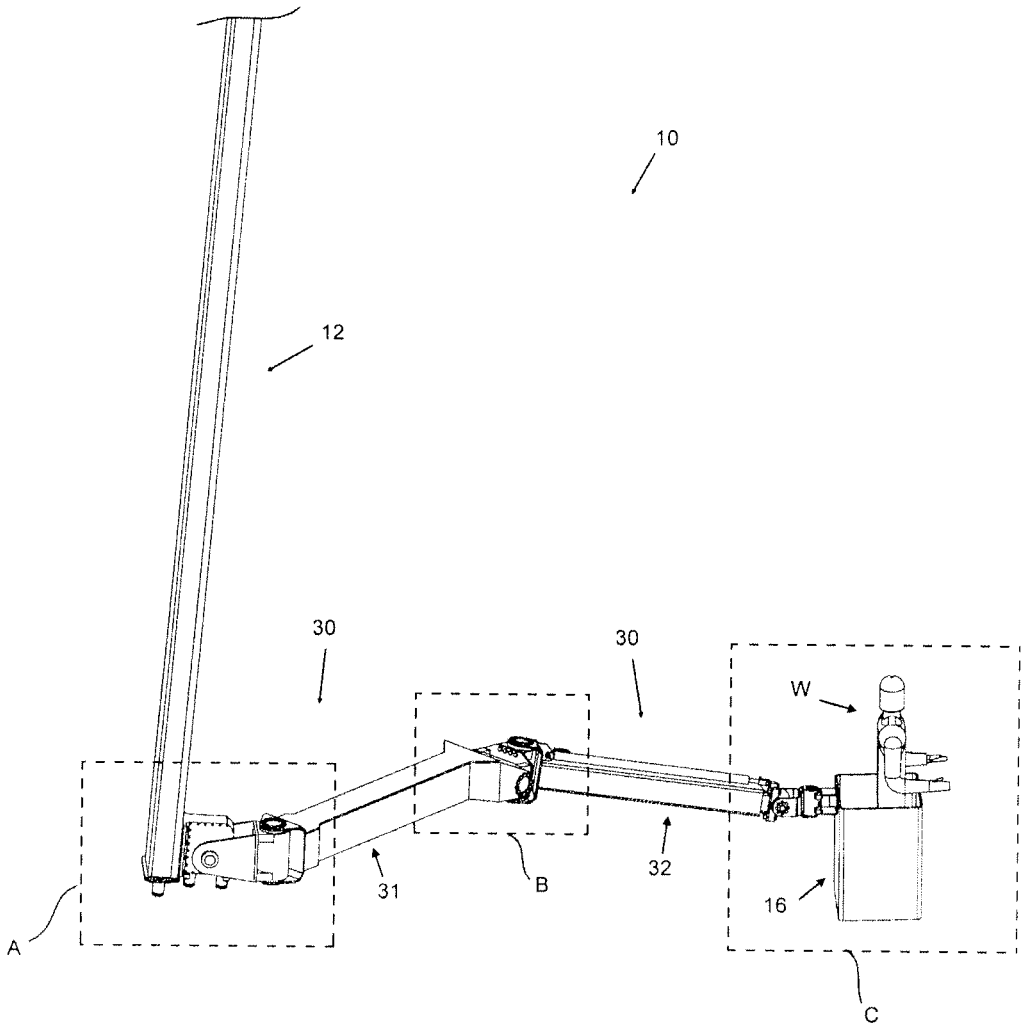
FIG. 10 is a side perspective view of the stabbing basket of the embodiment of FIG. 1, similar to that shown in FIG. 9, but with the rig and tubulars not shown.
Figure 11:
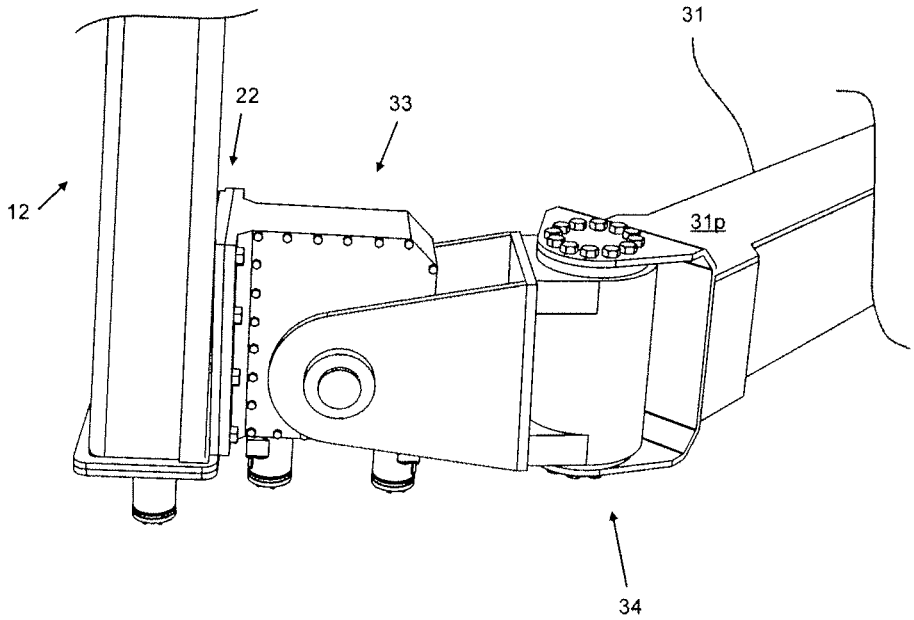
FIG. 11 is an enlargement of area A in FIG. 10.
Figure 12:
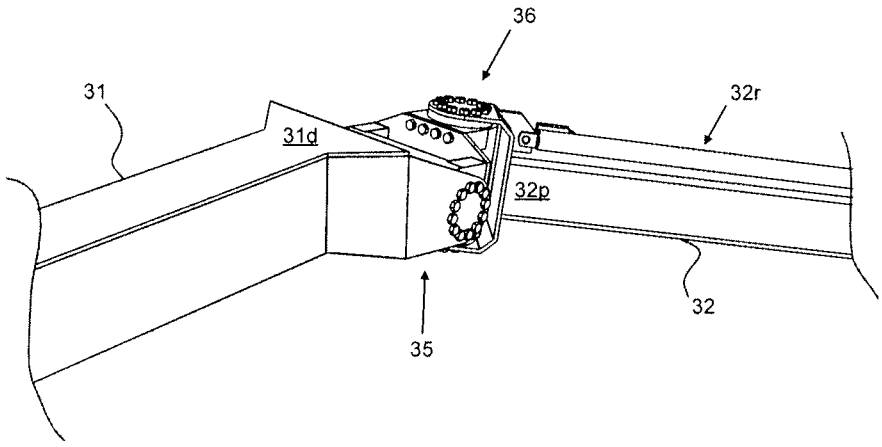
FIG. 12 is an enlargement of area B in FIG. 10.
Figure 13:
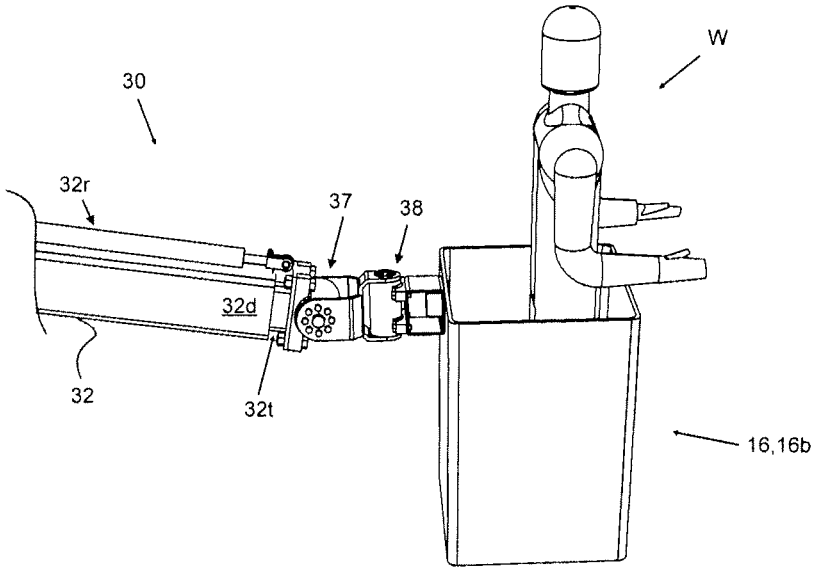
FIG. 13 is an enlargement of area C in FIG. 10.

FIGS. 1-13 illustrate the configuration of a preferred embodiment of the present invention. In this embodiment, stabbing basket 10 is adapted to be attached to a derrick or rig 11, from either the inside or outside as may be desired (shown in the figures as mounted to the inside), and for supporting a worker W in stabbing joints of tubular members T together during running operations.

The stabbing basket 10 of this embodiment comprises a frame member 12 to attach or mount the stabbing basket 10 to the rig 11, a platform 16 to support the worker W, a carriage 22 to slidably mount the platform 16 to the frame member 12, vertical power means for moving the carriage 22 and platform 16 vertically with respect to the frame member 12, and an articulating arm or boom 30 to interconnect the platform 16 with the carriage 22 and to facilitate horizontal and vertical movement of the platform 16 relative to the carriage 22 and frame member 12. Preferably, the platform 16 further comprises a safety basket 16*b* to form a working cage for the worker W utilizing the stabbing basket 10 of the present invention.

Unless otherwise specified, it is preferred that the components of the invention be made of steel or other suitable high-strength materials capable of taking stresses and strains encumbent upon such a stabbing basket 10 during its intended use during stabbing operations.

As is well known and preferred, the rig 11 has a plurality of braces or girders 11*g* connecting its legs 11*l*. Frame member 12 is adapted to be affixed with the rig 11, along either the rig's inside or outside periphery, using one or more of the rig's girders 11*g* or legs 11*l*, in a vertical plane substantially parallel with the tubulars T. Preferably, the stabbing basket 10 is permanently, or semi-permanently, attached to the rig 11, such as by welding or bolting the frame member 12 directly to the rig's girders 11*g* or legs 11*l*. It is preferred that the frame member 12 be of a rigid construction, as noted above.

The articulating boom 30 preferably comprises a first segment 31 and a second segment 32. First and second segments 31, 32 are preferably of a generally tubular configuration and of a rigid construction, as noted above. Preferably, the second segment 32 further comprises a telescoping member 32*t* which slides longitudinally within the second segment 32 in a conventional telescoping manner. More preferably, telescoping member 32*t* is actuated by a hydraulic ram 32*r* to further increase the reach of the platform 16 when required. In the preferred embodiment shown, the telescoping member 32*t* can extend, or telescope, up to 40 inches out from the second segment 32.

First segment 31 is pivotally connected to the carriage 22 to provide the boom 30 with both luffing L and slewing S ranges of motion. Preferably, first segment 31 is connected to carriage 22 through first and second substantially mutually perpendicular pivoting actuators 33, 34 connected, i.e. connected so that the pivoting axes of pivoting actuators 33, 34 are substantially mutually perpendicular, as shown in the figures.

First segment 31 is pivotally connected to second segment 32 by means of at least one pivoting actuator positioned between the distal end 31*d* of the first segment 31 and the proximal end 32*p* of the second segment 32. Preferably, first segment 31 is connected to second segment 32 through more than one pivoting actuator, such as through third and fourth substantially mutually perpendicular pivoting actuators 35, 36 connected so that the pivoting axes of pivoting actuators 35, 36 are substantially mutually perpendicular, as shown in the figures. More preferably, second segment 32, at its distal end 32*d*, is connected to platform 16 through fifth and sixth substantially mutually perpendicular pivoting actuators 37, 38 connected so that the pivoting axes of pivoting actuators 37, 38 are substantially mutually perpendicular, as shown in the figures.

Preferably, the first pivoting actuator 33 attaches or mounts to the carriage 22 in a conventional manner and is oriented to provide pivoting actuation of the boom 30 in a generally vertical plane, thereby providing the boom 30 with an up-and-down range of motion relative to the rig 11 and acting as the boom's luffing mechanism. More preferably, the second pivoting actuator 34 attaches or mounts to the proximal end 31*p* of the first segment 31 in a conventional manner and is oriented to provide pivoting actuation in a generally horizontal plane, thereby proving the boom 30 with a side-to-side range of motion relative to the rig 11 and acts as the boom's slewing mechanism. In another embodiment (not shown), the orientation of the first and second pivoting actuators is reversed so that the first pivoting actuator acts as the boom's slewing mechanism, while the second actuator acts as the boom's luffing mechanism.

In this embodiment, first pivoting actuator 33 preferably comprises a double-enveloping worm gearbox, while second pivoting actuator 34 comprises a rotary hydraulic actuator. Preferably, worm gearbox 33 utilizes a dual hydraulic motor drive system and a center to center distance that is favourable for self locking. More preferably, both pivoting actuators 33, 34 have a hydraulic brake for added safety. Advantageously, through the use of a worm gearbox and rotary actuator, a high degree of freedom of movement of the boom 30, relative to the rig 11 is possible. In the preferred embodiment shown, a circular arc of at least 200° of slewing motion S and a circular arc of at least 180° of luffing motion L is provided. In an alternate embodiment (not shown), both first and second pivoting actuators 33, 34 are comprised of rotary hydraulic actuators, providing similarly large ranges of luffing and slewing motions L,S to the boom 30. Both the worm gearbox 33 and the rotary actuator 34 are powered and actuated in a conventional manner.

A suitable hydraulic rotary actuator is an L30 series rotary actuator manufactured by the Helac Corporation of Enumclaw, Wash., U.S.A. Another suitable hydraulic actuator is the BV Helical rotary actuator manufactured by the HKS Group of Wä chtersbach Aufenau, Germany and their North American affiliate, HKS North America LLC of Atlanta, Ga., U.S.A.

Further in this embodiment, third, fourth, fifth and sixth pivoting actuators 35, 36, 37, 38 are all preferably comprised of rotary hydraulic actuators, such as those manufactured by either the Helac Corporation or the HKS Group and are powered and actuated in a conventional manner. Advantageously, third and fourth pivoting actuators 35, 36 provide for additional freedoms of movement of the boom 30, while fifth and sixth pivoting actuators 37, 38 allow for the platform 16 to be kept level while the boom 30 is actuated to a variety of positions through these various freedoms of movement. More advantageously, third, fourth, fifth and sixth pivoting actuators 35, 36, 37, 38 allow the stabbing basket 10 to be easily positioned around an obstacle or a tubular member T (see FIGS. 1-2 and 9) and allow a worker W to work in a remote area of the rig 11 that would not have been reachable using prior art stabbing baskets. For example, the stabbing basket 10 of the present invention allows a worker W to work on the rig's top drive TD at a position that is far away from, and opposite to, the side of the rig 11 to where the stabbing basket attaches (see FIGS. 4-5). Even more advantageously, the pivoting actuators 33, 34, 35, 36, 37, 38 enable the boom 30 to be stowed in a compact configuration when not in use (see FIGS. 6-8). Yet even more advantageously, the pivoting actuators 33, 34, 35, 36, 37, 38 enable the boom 30 to extended substantially vertical and downward, positioning the platform 16 at or near the rig floor allowing ease of entry or exit of a worker W on or off the platform 16 (see FIG. 3).

Alternatively, in another embodiment (not shown), the stabbing basket 10 does not have the frame member, the carriage nor the vertical power means. Instead, in this alternate embodiment, the stabbing basket 10 comprises a platform 16 to support the worker W and an articulating boom 30 to connect the platform 16 to the rig 11 and to facilitate horizontal and vertical movement of the platform 16 relative to the rig 11. Further in this embodiment, the articulating boom 30 comprises a first segment 31, a second segment 32 and at least one pivoting actuator positioned between the first segment 31 and the second segment 32.

The frame member 12 and carriage 22 facilitate vertical movement V of the stabbing basket 10, and of the boom 30, relative to the rig 11. Carriage 22 is slidably mounted within, and is constrained by, a longitudinal channel 12*a* within the frame member 12 in a conventional manner, allowing the carriage 22 to move along the frame's longitudinal axis. Since frame member 12 is mounted in a vertical plane substantially parallel with the tubulars T, and carriage 22 is mounted with the longitudinal channel 12*a* of the frame member 12, the stabbing basket 10 and boom 30 can move vertically along the rig 11. Preferably, a plurality of carriage rollers (not shown) are provided to facilitate said slidable vertical movement V of the carriage 22 within the longitudinal channel 12*a*.

The stabbing basket 10 of the present invention further comprises vertical power means to provide motive force for moving the carriage 22 vertically with respect to the frame member 12. Preferably, vertical power means is a leadscrew-based power means, further comprising a leadscrew 40 (threads not shown) mounted within the frame's longitudinal channel 12*a* substantially parallel with the frame member 12, a motor (not shown) to drive the leadscrew and a nut member (not shown) mounted on the carriage 22 to receive and treadably mate with the leadscrew 40 (leadscrew 40 otherwise passing through carriage through appropriate sized openings) and to translate the torque of the leadscrew 40 into linear vertical motive force on the carriage 22. More preferably, the threads of the leadscrew 40 and nut member have an Acme profile. Even more preferably the motor is a hydraulic motor or may alternatively be an electric, air or any other suitable type of motor. The carriage 22 (and the platform 16 and boom 30 mounted thereto) is movable vertically V along the frame member 12 upon actuation of the vertical power means.

Advantageously, the leadscrew-based power means is self-locking (i.e. when stopped, a linear force on the nut member will not apply a torque to the leadscrew 40). More advantageously, the vertical power means is therefore capable of holding vertical loads (such as the carriage 22, boom 30, platform 16 and any worker W positioned thereon) when the motor is turned of, thereby providing significant safety advantages over a winch and cable based power means such as that disclosed in U.S. Pat. No. 4,326,602 to Bryant.

During running operations the worker W preferably stands on the floor of the platform 16 for stabbing the appropriate tubular members T during such running operations. Should it be necessary that the platform 16 be raised or lowered, the worker merely actuates the vertical power means. In the preferred embodiment, the worker W actuates motor to turn in the appropriate direction, resulting in either upward or downward vertical movement of the carriage 22, and hence the platform 16, along the frame member 12 as may be required.

Should it be necessary that the platform 16 be moved towards or away from the tubular members T, slew or luff the boom 30 or pivotally adjust the second segment 32 relative to the first segment 31, the worker W merely actuates the appropriate pivoting actuators 33, 34, 35, 36. Likewise, should it be necessary to pivotally actuate the platform 16 relative to the second segment, so as to keep it level relative to the ground surface, the worker W merely actuates the appropriate pivoting actuators 37, 38.

As will be appreciated, the stabbing basket 10 of the present invention enables a worker W to efficiently and safely accomplish the stabbing of joints of tubular members during running operations. Advantageously, by having a boom 30 comprised of a first segment 31 and a second segment 32, and by having at least one pivoting actuator between said first and second segments 31, 32, the stabbing basket 10 can efficiently move the worker W around the interior or exterior space of the rig 11, including around obstacles such as the tubular members T. Thus, the present invention comprehends a stabbing basket 10 that is a new and useful concept not heretofore known.

Those of ordinary skill in the art will appreciate that various modifications to the invention as described herein will be possible without falling outside the scope of the invention.

The embodiments of the invention in which an exclusive property or privilege is being claimed are defined as follows:

1. A stabbing basket for a rig and for supporting a worker during running operations, comprising:

a frame member for mounting the stabbing basket to the rig;

a platform to support the worker;

a carriage to slidably mount the platform to the frame member;

vertical power means for moving the carriage vertically with respect to the frame member;

an articulating boom, interconnecting the platform with the carriage and to facilitate horizontal and vertical movement of the platform relative to the carriage and frame member, said articulating boom comprising a first segment and a second segment, the first segment and second segment each having a distal end and a proximate end, the proximate end of the first segment being pivotally connected to the carriage, the distal end of the first segment being pivotally connected to the proximate end of the second segment, and the distal end of the second segment being pivotally connected to the platform; and at least one pivoting actuator and a second pivoting actuator positioned between the distal end of the first segment and the proximate end of the second segment, wherein said at least one pivoting actuator and said second pivoting actuator are connected in a substantially mutually perpendicular arrangement.

2. The stabbing basket of claim 1 wherein the at least one pivoting actuator is a rotary hydraulic actuator.

3. The stabbing basket of claim 1 wherein the at least one pivoting actuator and the second pivoting actuator are both rotary hydraulic actuators.

4. The stabbing basket of claim 1 further comprising:

a third pivoting actuator; and a fourth pivoting actuator;

wherein said third and fourth pivoting actuators connect the articulating boom to the carriage and are arranged in a substantially mutually perpendicular manner.

5. The stabbing basket of claim 4 wherein the at least one pivoting actuator, the second pivoting actuator, the third pivoting actuator and the fourth pivoting actuator are all rotary hydraulic actuators.

6. The stabbing basket of claim 1 wherein the vertical power means comprises:

a leadscrew mounted within the frame member in a substantially vertical plane substantially parallel with said frame member;

a motor to drive the leadscrew; and a nut member mounted on the carriage to receive the leadscrew.

7. A stabbing basket for a rig and for supporting a worker during running operations, comprising:

a platform to support the worker;

an articulating boom, interconnecting the platform with the rig and to facilitate horizontal and vertical movement of the platform relative to the rig, said articulating boom comprising a first segment and a second segment, the first segment and second segment each having a distal end and a proximate end, the proximate end of the first segment being pivotally connected to the rig, the distal end of the first segment being pivotally connected to the proximate end of the second segment, and the distal end of the second segment being pivotally connected to the platform; and at least one pivoting actuator and a second pivoting actuator positioned between the distal end of the first segment and the proximate end of the second segment, wherein said at least one pivoting actuator and said second pivoting actuator are connected in a substantially mutually perpendicular arrangement.

8. The stabbing basket of claim 7 wherein the at least one pivoting actuator is a rotary hydraulic actuator.

9. The stabbing basket of claim 7 wherein the at least one pivoting actuator and the second pivoting actuator are both rotary hydraulic actuators.

10. The stabbing basket of claim 7 further comprising:

a third pivoting actuator; and a fourth pivoting actuator;

wherein said third and fourth pivoting actuators connect the articulating boom to the carriage and are arranged in a substantially mutually perpendicular manner.

11. The stabbing basket of claim 10 wherein the at least one pivoting actuator, the second pivoting actuator, the third pivoting actuator and the fourth pivoting actuator are all rotary hydraulic actuators.

* * * * *

UNITED STATES PATENT AND TRADEMARK OFFICE

CERTIFICATE OF CORRECTION

PATENT NO. : 8,800,716 B2
APPLICATION NO. : 13/615490
DATED : August 12, 2014
INVENTOR(S) : Vince Morelli and Darcy Ludwig It is certified that error appears in the above-identified patent and that said Letters Patent is hereby corrected as shown below:

Title Page, item 75 should read

Inventors: Vince Morelli and Darcy Ludwig

Signed and Sealed this
Nineteenth Day of May, 2015

Michelle K. Lee

Michelle K. Lee
*Director of the United States Patent and Trademark Office*